106-18.17 SR
4/12/88 XR 4,737,406

United States Patent [19]
Bumpus

[11] Patent Number: 4,737,406
[45] Date of Patent: Apr. 12, 1988

[54] FLAME RETARDANT TREATMENT

[76] Inventor: Patrick D. Bumpus, 44 Chedell Pl., Auburn, N.Y. 13021

[21] Appl. No.: 874,275

[22] Filed: Jun. 12, 1986

[51] Int. Cl.[4] ..... D04H 1/58; B05D 3/02; C09D 5/16

[52] U.S. Cl. ..... 428/288; 106/18.16; 106/18.17; 106/18.22; 427/389.9; 427/393.3

[58] Field of Search ..... 252/606, 607, 608; 106/18.17, 18.16, 18.22; 427/389.9, 393.3; 428/288, 365

[56] References Cited

U.S. PATENT DOCUMENTS 2,378,714 6/1945 Leatherman ..... 106/18.17
3,811,992 5/1974 Handa et al. ..... 106/18.17 X
4,224,169 9/1980 Retana ..... 106/18.16 X
4,228,202 10/1980 Tjännberg ..... 106/18.16 X
4,374,171 2/1983 McCarter ..... 428/288
4,588,523 5/1986 Tashlick et al. ..... 252/606

*Primary Examiner*—Thurman K. Page
*Attorney, Agent, or Firm*—Bruns and Wall

[57] ABSTRACT

A flame retardant or fire retardant preparation can be employed with fibrous material containing either cellulosic fibers, non-absorbent fibers, or blends thereof. The preparation is formed of an aqueous solution of ammonium sulfate, a metasilicate salt serving as a binder, and ammonium phosphate (MAP or DAP). An ultraviolet inhibitor is preferably included in the solution.

22 Claims, No Drawings

FLAME RETARDANT TREATMENT

BACKGROUND OF THE INVENTION

This invention relates to fire-retardant or flame-retardant preparations, and to articles treated with such preparations.

There is an increasing need in industry, in public places, and in the home for treatment of flammable articles to render them fire resistant or flame resistant. This requirement applies to children's clothing, and also applies to drapes, carpets, and the like for hotels and motels, and to wall coverings for public places. Flame proofing or flame retardancy is now being required even for displays and the like. Flame proofing and fire proofing is also desirable, if not required, for upholstered furniture, for vehicle interiors, and for industrial gloves and outer clothing. Flame retardancy is also required in some situations for mattresses and is desirable for paper products, wall hangings and other flammable items.

The conventional method of treating these articles for fire or flame retardancy is to apply an aqueous solution of an inorganic salt having fire-retardant characteristics, and then to dry the article. However, because these conventional treatments involve a soluble inorganic salt, the durability of the treatment is quite limited, as the salt dissolves or leaches out in moisture and can be washed away by laundering or dry cleaning, or simply by perspiration or high humidity conditions. Another problem of conventional treatments is that the inorganic salt employed as a fire-retardant can bring stiffness and/or discoloration to the treated article. Furthermore, because the inorganic salt can be somewhat toxic, the amount that can be employed for a given area of fabric is somewhat limited.

It would be desirable to supply the treatment as a self-application kit, e.g. for use by schools, parent, theater groups, etc. This would provide a safe and simple means for those without special skills or training to apply the treatment. Such a self-application kit would, of course, facilitate the treatment in place of existing drapes, carpeting, etc., without requiring their removal and reinstallation. However, to the best of applicant's knowledge no such kit has been made available.

Another problem with the previously-proposed flame- or fire-retardant treatments is their incompatibility with synthetic, high-polymer content fiber products. This is a problem derived from the need for water soluble inorganic salts, which have little if any tendency to bond to the surfaces of the synthetic organic polymer fibers.

OBJECTS AND SUMMARY OF THE INVENTION

It is an object of this invention to provide a fire- or flame-retardant treatment which avoids the drawbacks of the prior art.

It is a more particular object of this invention to provide a fire- or flame-retardant treatment which can be applied to natural, i.e. cellulosic fiber products or to synthetic polymer fiber products, which is persistent and durable, which does not lose its flame- or fire-retardant properties if the treated article is washed or laundered, and which does not adversely affect the texture or color of the treated article.

It is yet another object of this invention to provide a flame- or fire-retardant treatment which can be applied to carpeting, drapery, or other installed articles while in place and which can be applied to articles formed of cellulosic fibers, of high-polymer absorbent fibers, or of blends of these.

According to an object of this invention, a flame- or fire-retardant preparation is formed of an aqueous solution of ammonium sulfate, a metasilicate salt, such as sodium metasilicate, serving as a binder, and an ammonium phosphate, such as monoammonium phosphate (MAP) or diammonium phosphate (DAP). In a typical preferred treatment, the aqueous solution consists essentially of about 0.9 parts sodium metasilicate, about 13.0 parts ammonium sulfate, about 4.12 parts monoammonium phosphate, and sufficient water to make up 100 parts. To this an ultraviolet inhibitor can be added.

The dissolved ammonium sulfate penetrates into cellulosic fibers, such as cotton, wool, cellulose, etc., and the sodium metasilicate assists the bonding of the ammonium sulfate both to the cellulosic fibers and also to non-absorbent fibers, such as nylon, acetate, polyester, polypropylene, etc. Monoammonium phosphate covers and bonds to the surface of the non-absorbent fibers, and the presence of the sodium metasilicate facilitates this.

The inclusion of the MAP or DAP cures one major defect in the prior-art treatment of these fibers. Synthetic polymer fibers have tended to defy conventional fire-retardant treatments, as nylon, acetate, polyethelene, polyester, polypropylene, polyolefin and the like, when heated, decompose and give off a flammable gas. An organic salt by itself does nothing to prevent this decomposition or the combustion of the resulting gas, and will not prevent flame spread in such materials. However, the monoammonium phosphate and diammonium phosphate, when heated above about 260 degrees C., also decompose and give off a self-extinguishing gas which starves the oxygen from the fibers and from the decomposition gasses, thereby preventing flame spread. In addition, the MAP or DAP, in combination with the other ingredients, increases durability of the fire retardancy.

Superior flame- or fire-retardant properties for cellulosic-fiber materials can be achieved with an aqueous solution of only the ammonium sulfate and the sodium metasilicate. This solution also works well for blends of cellulosic and non-absorbent fibers up to about 70% non-absorbent fibers. However, over that limit, monoammonium phosphate or diammonium phosphate is needed.

The above and many other objects, features, and advantages of this invention will be more fully understood from the ensuing detailed description of a preferred embodiment.

DETAILED DESCRIPTION OF A PREFERRED EMBODIMENT

In the preferred embodiment of this invention, the flame- or fire-retardant preparation is formed as an aqueous solution of ammonium sulfate, sodium metasilicate, and an ammonium phosphate, preferrably monoammonium phosphate (MAP). The ammonium sulfate, a fire-retardant soluble inorganic salt, penetrates into the fibers of the absorbent or "cellulosic" fibrous materials, and the metasilicate salt serves as a binder for the ammonium sulfate. The MAP attaches to the non-absorbent synthetic fibers, such as polyesters, polypropylenes, nylons or polyamides, acetates or polyacetates, polyolefins, polyethelenes, and the like. The metasilicate salt affects the surface characteristics of the materials, and also affects some bonding of the ammonium sulfate to the non-absorbent fibers. MAP or DAP, in the presence of elevated temperatures, serves as an oxygen-starving agent. The MAP or DAP breaks down chemically at temperatures above about 260 degrees C., and the breakdown products starve oxygen from the gaseous flammable gases that emanate from heat decomposition of the non-absorbent fibers. This has proved an effective way of preventing spread of fire and flame in synthetic polymer materials. By contrast, conventional inorganic salts that are often used for flame- or fire-retardant treatment will not prevent flame spread in these synthetic materials.

The preferred preparation is formed of 0.9 parts of sodium metasilicate, 13.0 parts of ammonium sulfate, 4.12 parts of MAP, and sufficient water to make up 100 parts. These parts are by weight. This blend represents the maximum amount of the chemicals that can be dissolved in water and remain in solution. Nevertheless, there is some trade off between the ammonium sulfate and the MAP, that is, if a greater amount of one of these chemicals is desired, the solution can accommodate it by using less of the other. Current experiments seem to indicate that the two together can constitute up to about twenty percent of the solution. Accordingly, the blend of ingredients can be tailored to suit a specific fabric, if the amount and types of fibers are known. Any combination of MAP or DAP with Ammonium Sulfate (up to this total of about twenty percent) will have good fire retardancy, but the optimum protection seems to be with the above mentioned blend. The amount of sodium metasilicate used in this example is sufficient for adequate bonding of the ammonium sulfate. It is desired to limit the amount of this ingredient, however, to keep the toxicity of the preparation to a minimum, and to keep the alkalinity low. A weak acid can be added to the solution, in dilute amounts, if it is feared the rather high pH of the sodium metasilicate would affect the fibers. However, this is virtually never necessary.

Preferably, an ultraviolet inhibitor is incorporated into the solution, and this should be a water soluble UV inhibitor that does not react with the other chemicals, and does not diminish the amount that can be dissolved. It has been found that two parts per hundred of UVINUL MS-40 water soluble UV inhibitor provides satisfactory results. UVINUL MS-40 is a trademark of BASF $W_1$/Andotte Chemical Co.

The ammonium sulfate, MAP, and DAP are white to light grayish in color, and so constitute a generally colorless treatment. The treatment does not affect the color or texture of the fabric or other fibrous material that is treated, nor is there noticeable stiffening of the treated material, as is often the case with conventional fire-retardant treatments. Also, the chemicals involved here are all considered safe and are not regarded as toxic. The sodium metasilicate, while quite alkaline, is considered safe when used in the dilute concentration indicated here. The UV inhibitor employed is also safe and colorless.

The treatment is preferably applied by spraying the aqueous solution onto the material, or by dipping the material into the solution. The water is then evaporated from the sprayed or dipped material. Evaporation of the water can be accelerated by the application of heat or dry air.

Because of the binding effect of the sodium metasilicate and the natural bonding characteristics of the MAP, the fire- or flame-retarding treatment of this invention has been found to be exceptionally durable, and is not noticeably diminished, even by ten or more cycles of laundering or dry cleaning. Thus, the treatment is considered permanent. Products treated with this preparation have been found to have a flame spread index of five, under the standard ASTM E84 Steinner Tunnel Test, and usually meet the requirements for class A fire retardancy, even after ten cycles of laundering or dry cleaning.

The preparation of this invention can be easily applied to previously installed carpeting, drapery, upholstery, etc., for retreatment thereof. Application involves simply spraying the preparation onto the drapery, carpeting, or the like, and permitting the same to dry. This obviates the need to have carpeting removed and replaced with new, treated carpeting, simply in order to meet a change in fire code requirements.

The preparation of this invention naturally lends itself to use in self-application kits, which include a container of the preparation and a sprayer device. By following a simple set of instructions relating to the simple steps mentioned previously, school custodial personnel, parents, theater groups, or others without any special training can apply this fire- or flame-retardant treatment to fabrics or other fibrous products.

The fire- or flame-retardant preparation of this invention can be applied to carpets, furniture, draperies, curtains, pillows, clothing, display items, paper items, wood, wallpaper, and building materials, or other products which are bodies of fibrous material.

It has been found that if the MAP or DAP ingredient is omitted from the preparation, blends of fibers of up to 70% polyester (e.g., at least 30% cotton or wool) will receive adequate protection. However, for fiber blends of more than 70% polyester, MAP or DAP is required.

In the above-described embodiment, water is employed as the solvent or vehicle for the other ingredients, and water has been selected as a safe, non-toxic and non-flammable carrier. However, for a controlled industrial application where high speed of drying is required, an organic solvent could be substituted as the vehicle or carrier. Such solvent should be inert as to the fibers or material being treated.

Fabrics treated with the preparations described hereinabove have been found to pass all current flame spread tests, including ASTM E84 (Class A), Federal Aviation Agency horizontal and vertical flame spread tests, and the NFPA-701 test; the treated materials were found to have indexes at least as good as these:

Flame Spread Index—5
Fuel Contributed—10
Smoke Developed—15

While a particular embodiment of this invention has been described in detail hereinabove, it should be recognized that this invention is not limited to that embodiment, and that many modifications and variations thereof would present themselves to those of skill in the art without departing from the scope and spirit of this invention, as defined in the appended claims.

I claim:

1. A flame-retardant or fire-retardant preparation consisting essentially of an aqueous solution of ammonium sulfate, a metasilicate salt serving as a binder, and ammonium phosphate.

2. The preparation of claim 1 wherein said ammonium phosphate is monoammonium phosphate.

3. The preparation of claim 1 wherein said ammonium phosphate is diammonium phosphate.

4. The preparation of claim 1 wherein said metasilicate salt constitutes substantially 0.9% of the aqueous solution.

5. The preparation of claim 1 wherein said ammonium sulfate and said ammonium phosphate together constitute substantially about seventeen percent of the aqueous solution.

6. The preparation of claim 1 wherein said aqueous solution consists essentially of about 0.9 parts sodium metasilicate, about 13.0 parts ammonium sulfate, about 4.12 parts monoammonium phosphate, and sufficient water to make up 100 parts.

7. A flame-retardant or fire-retardant preparation consisting essentially of an aqueous solution of ammonium sulfate, a metasilicate salt serving as a binder, and ammonium phosphate, and an ultraviolet inhibitor in said aqueous solution with said ammonium sulfate, said metasilicate salt, and said ammonium phosphate.

8. The preparation of claim 7 wherein said ultraviolet inhibitor comprises a substituted benzophenone in an amount of 2 parts per 100.

9. A flame-retardant or fire-retardant preparation consisting essentially of an aqueous solution of ammonium sulfate and a metasilicate salt serving as a binder.

10. The preparation of claim 9 which consists essentially of about 0.9 parts of sodium metasilicate, about 13 parts of said ammonium sulfate, and water sufficient to make up 100 parts.

11. A flame-retardant or fire-retardant preparation consisting essentially of a solution of ammonium sulfate, a metasilicate salt serving as a binder, an ammonium phosphate, and an evaporable liquid vehicle carrying said ammonium sulfate, said metasilicate salt and said ammonium phosphate.

12. A flame-retardant or fire-retardant preparation consisting essentially of a solution of ammonium sulfate, a metasilicate salt serving as a binder, and an evaporable liquid vehicle carrying said ammonium sulfate and said metasilicate salt.

13. An article treated to be fire-retardant or flame-retardant, said article comprising a mass of fibrous material including cellulosic fibers, and an effective amount of a fire-retardant treatment consisting essentially of ammonium sulfate and a salt which serves as a binder to bind the ammonium sulfate to said fibers, said fire-retardant treatment having been applied to said fibers as a solution of ammonium sulfate and said salt and thereafter dried.

14. An article treated to be fire-retardant or flame-retardant, said article comprising a mass of fibrous material including non-absorbent fibers, and an effective amount of a fire-retardant treatment consisting essentially of ammonium sulfate, an ammonium phosphate, and a salt which serves as a binder to bind the ammonium sulfate and the ammonium phosphate to said non-absorbent fibers, said fire-retardant treatment having been applied to said fibers as a solution of ammonium sulfate, ammonium phosphate and said salt, and the mass of fibrous material having been thereafter dried.

15. An article as in claim 14, in which said non-absorbent fibers include synthetic polymer fibers.

16. An article as in claim 15, in which said synthetic polymer fibers are selected from the group consisting of polyamides, polyolefins, polyethelenes, polyacetates, polyesters, and polypropylenes.

17. An article as in claim 15 in which said article also comprises an ultraviolet inhibitor included in said solution and applied to said non-absorbent fibers with said ammonium sulfate, said ammonium phospate, and said binder salt.

18. A process for treating a fibrous article comprising wetting the article with a flame-retardant or fire-retardant solution consisting essentially of an evaporable liquid vehicle, ammonium sulfate, and a metasilicate salt serving as a binder to bind said ammonium sulfate to fibers of said article, and evaporating the vehicle from the wetted article.

19. A process for treating a fibrous article comprising wetting the article with a flame-retardant or fire-retardant solution consisting essentially of an evaporable liquid vehicle, ammonium phosphate, ammonium sulfate, and a metasilicate salt serving as a binder to bind said ammonium sulfate and said ammonium phosphate to fibers of said article, and evaporating the vehicle from the wetted article.

20. The process of claim 18, wherein said wetting includes spraying the solution onto the article.

21. The process of claim 18, wherein said wetting includes dipping the article into said solution.

22. The preparation of claim 7 wherein said ultraviolet inhibitor comprises 2-hydroxy-4-methoxy-benzophenone-5-sulfonic acid in an amount of 2 parts per 100.

* * * * *